United States Patent [19]

Ueno et al.

[11] 4,143,790

[45] Mar. 13, 1979

[54] COATED METAL STRUCTURE AND PROCESS FOR PRODUCTION THEREOF

[75] Inventors: Hiroshi Ueno, Yokosuka; Michiko Tsurumaru, Tokyo; Shinya Otsuka, Yokohama; Hiroshi Matsubayashi, Kamakura; Masanori Aizawa, Yokohama; Hiroki Sano, Yokosuka; Yukio Suzuki, Kawasaki, all of Japan

[73] Assignees: Toray Industries, Inc.; Toyo Seikan Kaisha Ltd., both of Tokyo, Japan

[21] Appl. No.: 743,662

[22] Filed: Nov. 22, 1976

[30] Foreign Application Priority Data

Nov. 26, 1975 [JP] Japan ..... 50-140792

[51] Int. Cl.[2] ..... B65D 25/14

[52] U.S. Cl. ..... 220/458; 428/35; 428/458

[58] Field of Search ..... 220/64, 66, 458, 65; 428/458, 35; 427/374; 264/216

[56] References Cited

U.S. PATENT DOCUMENTS

| | | | |
|---|---|---|---|
| 2,892,747 | 6/1959 | Dye | 428/458 |
| 2,961,365 | 11/1960 | Sroog | 428/458 |
| 3,054,703 | 9/1962 | Brasure | 428/458 |
| 3,655,349 | 4/1972 | Shah et al. | 220/64 |
| 3,832,962 | 9/1974 | Rolles | 220/64 |
| 3,979,009 | 9/1976 | Walker | 220/66 |

*Primary Examiner*—Michael F. Esposito
*Assistant Examiner*—Janyce A. Bell
*Attorney, Agent, or Firm*—Diller, Ramik & Wight

[57] ABSTRACT

In a coated metal structure comprising a metal substrate and a coating layer of a thermoplastic polyester resin heat-bonded to the metal surface, the polyester resin has a relative viscosity of 1.2 to 1.8 as measured at 25° C. in o-chlorophenol at a concentration of 0.5 g/100 ml and the tack point of the polyester resin is not lower than 130° C. and the degree of crystallinity of the polyester resin is up to 30%.

This structure has improved peel resistance and is excellent in mechanical and chemical properties, especially adaptability to shaping processing and corrosion resistance. This structure can easily be formed into various vessels and containers and closure means of vessels and containers by such processing as drawing and ironing. This structure provides shaped articles excellent in peel resistance, corrosion resistance and processability.

11 Claims, No Drawings

COATED METAL STRUCTURE AND PROCESS FOR PRODUCTION THEREOF

This invention relates to a coated metal structure excellent in peel resistance, adaptability to shaping processing and corrosion resistance, which comprises a metal substrate and a coating layer of a thermoplastic polyester resin heat-bonded to the metal substrate, and to a process for the production of such coated metal structure.

In order to impart corrosion resistance to metallic materials, methods comprising coating surfaces of metallic materials with resin layers have heretofore been broadly adopted in the art. As typical instances of such conventional coating method, there can be mentioned a method comprising coating a solution or dispersion of a thermosetting resin such as an epoxy resin, a phenolic resin, a polyester resin or an acrylic resin in a suitable solvent on the surface of a metallic material, heating the coating to remove the solvent and effect curing of the resin layer and thus forming a resin coating on the surface of the metallic material, and a method comprising applying an adhesive composed mainly of a polyfunctional isocyanate, epoxy or phenol compound on the surface of a film of a thermoplastic resin such as a vinyl chloride resin, a polyolefin resin, a polyester resin or an acrylic resin or on the surface of a metallic material and bonding them through the adhesive layer. These conventional methods, however, are defective in various points. For example, since a number of steps such as heating, curing and solvent removal are required for obtaining intended coated metal structures, the productivity is very low. Further, since the coated resin layer is composed of a thermosetting resin having a very low elongation or such thermosetting resin is present as the bonding layer between the resin layer and the metal substrate, the resulting coated metal structures are very poor in adaptability to shaping processability. Therefore, although it is possible to subject these coated metal structures to relatively simple shaping processing with a low ratio of reduction or deformation such as folding and bending, it generally is difficult to subject these coated metal structures to complicated shaping processing with a high ratio of reduction or deformation such as deep drawing and ironing.

As means for overcoming such disadvantages involved in the conventional methods, there has been proposed a method in which a coated metal is heated before it is deformed for shaping (see Japanese Patent Publication No. 13728/66). Even according to this method, however, it is impossible to improve the adaptability to shaping processing sufficiently.

As a method which overcomes substantially the foregoing defects, a metal coating method utilizing the heat bonding technique has recently been adopted in the art, and metal structures coated with various thermoplastic resins such as polyolefin resins and vinyl chloride resins are now provided in the market. These metal structures, however, are still insufficient in various points. For example, since the bonding between the metal substrate and the resin layer is insufficient and the mechanical properties of the resin layer are poor, when the coated metal structure is subjected to shaping processing with a high ratio of reduction or deformation, peeling and breakage of the resin layer is readily caused. Further, since the heat resistance of the coating resin layer is very low, it is difficult or substantially impossible to apply the coated metal structure to a use where the coated metal structure is exposed to high temperatures or it it subjected to a heat treatment.

Under such background, we made research works with a view to overcoming the defects and disadvantages involved in conventional coated metal structures formed by using a thermoplastic resin and developing a coated metal shaped article excellent in the bonding between a coating resin layer and a metal substrate and in physical and chemical properties of the coating resin layer. As a result, we found that when a polyester type thermoplastic resin is used as the coating resin and this polyester type thermoplastic resin is heat-bonded to a metal substrate, the foregoing defects and disadvantages can be remarkably moderated and substantially overcome.

It is known that a special polyester type thermoplastic resin composition can be used as a hot melt adhesive for metals and the like (see, for example, Japanese Patent Publication No. 4543/74 and Japanese Patent Application Laid-Open Specification No. 434/71). A polyester type resin composition that is applied to such technique is required to have a low melting point, and the mechanical strength of this resin is low. More specifically, properties of a polyester type thermoplastic resin that is used as a hot melt adhesive are quite different from properties which must be possessed by a resin that is used for formation of a coating layer on a metal substrate. Accordingly, it has generally be considered that such polyester type thermoplastic resin cannot be effectively used for coating metallic materials. Contrary to such general concept held in the art, we found that when a polyester resin layer formed on the surface of a metal substrate by heat bonding has a relatively high melting point and a relatively high degree of polymerization and its degree of crystallinity is in a specific range, a coated metal structure having improved peel resistance, improved adaptability to shaping processing and improved corrosion resistance can be obtained. Based on this finding, we have now completed the present invention.

More specifically, in accordance with the present invention, there is provided a coated metal structure comprising a metal substrate and a layer composed mainly of a thermoplastic polyester resin which is heat-bonded on the surface of said metal substrate, wherein said polyester resin has a relative viscosity of 1.2 to 1.8 as measured at 25° C. in o-chlorophenol at a concentration of 0.5 g/100 ml, and the tack point of said polyester resin is not lower than 130° C. and the degree of crystallinity of said polyester resin is up to 30%.

The thermoplastic polyester resin that is used as a resin layer in the present invention includes homopolyesters, copolyester and polyester-ethers comprising as the dibasic acid component an aromatic or aliphatic dicarboxylic acid such as terephthalic acid, isophthalic acid, phthalic acid, naphthalenedicarboxylic acid, azelaic acid, sebacic acid, adipic acid or dodecane-dicarboxylic acid and as the diol component an aliphatic or alicyclic glycol such as ethylene glycol, diethylene glycol, polyethylene glycol, propylene glycol, 1,4-butane diol, polytetramethylene glycol, 1,6-hexane diol, 1,10-decane diol, neopentyl glycol or 1,4-cyclohexane diol. Thermoplastic polyester resins comprising a dicarboxylic acid component containing at least 45 mole % of terephthalic acid and a diol component, especially one containing at least 45 mole % of 1,4-butane diol, are particularly preferred because they provide resin layers having good mechanical properties and good crystallinity characteristics. These polyester resins must have such a high strength that even when at the step of shaping the resulting coated metal structure, the coating layer is deformed in follow-up of flow of the metal surface by deformation of the metal, no breakage or crack is formed in the resin coating. In order to obtain a resin coating having such high strength, it is preferred to use a thermoplastic polyester resin having a relative viscosity of at least 1.2, especially at least 1.25, as measured at 25° C. in o-chlorophenol at a concentration of 0.5 g/100 ml. If this relative viscosity is higher than 1.8, the film-forming property and heat-bonding characteristic of the thermoplastic polyester resin are degraded. Accordingly, use of a polyester resin having such a high relative viscosity is not preferred for attaining the objects of the present invention.

In general, it is preferred that a homopolyester, copolyester or polyester-ether that is used in the present invention be composed of recurring units represented by the following general formula:

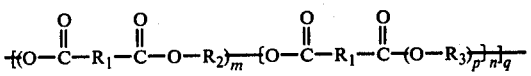

(1)

wherein $R_1$ stands for a divalent hydrocarbon group, at least 45 mole %, especially at least 60 mole %, of which is preferably a p-phenylene group, $R_2$ and $R_3$, which may be the same or different, stand for a divalent aliphatic hydrocarbon group, at least 45 mole %, especially at least 55 mole %, of which is a tetramethylene group, p and q stand for a number of at least 1, and m and n stand for 0 or a number of at least 1, with the proviso that when one of m and n is 0, the other must be a number of at least 1.

As the divalent hydrocarbon group $R_1$ in the above general formula, there can be mentioned, for example, linear and branched alkylene groups having 2 to 13 carbon atoms, cycloalkylene groups having 4 to 12 carbon atoms and arylene groups having 6 to 15 carbon atoms. In view of the corrosion resistance, extraction resistance and mechanical properties of the coating resin layer, it is preferred that the divalent hydrocarbon group $R_1$ be wholly composed of an arylene group such as mentioned above, but it is permissible that up to 55 mole % of the total divalent hydrocarbon group $R_1$ will be substituted by an alkylene or cycloalkylene group such as mentioned above. As the arylene group, in addition to a p-phenylene group, there can be mentioned o- and m-phenylene groups, a naphthylene group and groups represented by the following formula:

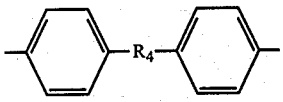

in which $R_4$ is a direct single bond or a divalent bridging group such as —O—, —$CH_2$—, —$CH(CH_3)$—, —$C(CH_3)_2$— or —NH—.

Alkylene groups having 2 to 13 carbon atoms can be mentioned as the alkylene groups $R_2$ and $R_3$, and among them, linear alkylene groups are preferred. The divalent aliphatic hydrocarbon group may contain, in an amount not exceeding 55 mole % of the total diol component, a group other than the alkylene group, for example, an aliphatic hydrocarbon group containing an aromatic or saturated ring such as an o-xylene group, a m-xylene group, a p-xylene group or a 1,4-dimethylenecyclohexylene group as an interposing group.

The diol component may be contained in the homopolyester, copolyester or polyester-ether that is used in the present invention in any of the following 3 states. Namely, (a) all the diol component is connected with the dibasic acid component and all the diol component is contained in the form of ester recurring units; (b) all the diol component is contained in the form of ester-ether recurring units; and (c) a part of the diol component is contained in the form of ester recurring units and the remainder of the diol component is contained in the state where the polyether glycol is connected with the dibasic acid component, namely in the form of ether-ester recurring units.

In the case of (a) above, the recurring number n of the ester-ether unit is zero or the number p in the ester-ether unit is 1 in the above general formula (1), and the polyester is a homopolyester or copolyester composed solely of ester recurring units (A). Preferred examples of such homopolyester or copolyester are poly(tetramethylene terephthalate), poly(propylene terephthalate), poly(tetramethylene/ethylene terephthalate), poly(tetramethylene terephthalate/isophthalate), poly(tetramethylene/ethylene terephthalate/isophthalate) and poly(tetramethylene/ethylene terephthalate/hexahydroterephthalate).

In the case of (b) above, the recurring number of the ester unit (A) is zero and the recurring number of the ether unit is at least 2 in the above general formula (1). In short, in this case, the polyester is a polyester-ether composed solely of ester-ether units (B). It is preferred that the recurring number p of the ether unit be so that the average molecular weight of polyethylene glycol be in the range of from 200 to 4,000, especially from 400 to 2,000. Preferred examples of such polyester-ether are poly(oxytetramethylene terephthalate), poly(oxyethylene terephthalate), poly(oxytetramethylene/oxyethylene terephthalate) and poly(oxytetramethylene/oxyethylene terephthalate/isophthalate).

In the case of (c) above, in the above general (1), both m and n stand for a number of at least 1, and p is a number of at least 2. In this case, the manner of connection of ester units (A) and ester-ether units (B) is not particularly critical. In other words, the polyester of this type may be a block copolymer represented by the following formula:

$$(A)_m - (B)_n,$$

$$(A)_m - (B)_n - (A)_m,$$

$$(B)_n - (A)_m - (B)_n,$$

or $$-(A)_m - (B)_n - (A)_m - (B)_n -$$

or a random copolymer represented by the following formula:

A—A—A—B—A—A—B—B—B

In the instant specification, when the degree of polymerization of the polyether glycol in the polyester is p, calculation is made while regarding 1 mole of this polyether glycol as p moles of the glycol.

Suitable examples of the copolyester of this type are tetramethylene terephthalate/polyoxytetramethylene terephthalate, tetramethylene terephthalate/polyoxyethylene terephthalate, ethylene terephthalate/-polyoxytetramethylene terephthalate, tetramethylene terephthalate/polyoxytetramethylene terephthalate, tetramethylene terephthalate/polyoxytetramethylene terephthalate/polyoxyethylene terephthalate, polytetramethylene terephthalate/polytetramethylene glycol block copolymers, polytetramethylene terephthalate/-polytetramethylene glycol/polyethylene glycol block copolymers and polytetramethylene terephthalate/-polypropylene glycol/polytetramethylene glycol/-polyethylene glycol block copolymers.

In the present invention, the foregoing homopolyesters, copolyesters and polyester-ethers may be used singly or in the form of blends of two or more of them.

In the present invention, in order to further improve the resin layer and the metal substrate or further improve surface characteristics of the resin layer, it is possible to incorporate into a thermoplastic polyester resin that is used as the resin layer a resin other than the polyester resin in an amount of up to 30% by weight of the total weight of the resin layer. As such auxiliary resin, there can be mentioned, for example, polyolefin resins such as polyethylene, ethylene-vinyl acetate copolymers, saponified ethylene-vinyl acetate copolymers, grafted ethylene-vinyl acetate copolymers, ethylene-acrylic acid copolymers, metal salts of ethylene-acrylic acid copolymers, polypropylene and modified propylene polymers, vinyl type resins such as polystyrene, copolymers of styrene with other vinyl monomer, homopolymers and copolymers of acrylic acid esters and homopolymers and copolymers of methacrylic acid esters, polyamide resins, and epoxy resins of the bisphenol A type. These resins may be used singly or in the form of mixtures of two or more of them. Moreover, in order to enhance the thermal stability, weatherability and flame resistance, it is possible to incorporate known additives effective for these improvements into a thermoplastic polyester resin that is used as the resin layer in the present invention.

The tack point ($T_1$) of the polyester resin layer coated on a metal substrate is very important for the shapability or processability of the resulting coated metal structure. It is preferred that the tack point ($T_1$) be at least 130° C., especially at least 150° C., and be not higher than 250° C., especially not higher than 240° C.

The tack point means a temperature at which the polyester resin layer begins to adhere to the metal substrate heated. More specifically, a polyester resin film is placed on a metal substrate and the metal substrate is heated under application of a pressure of 100 g/cm$^2$, and the lowest temperature at which the film is fusion-bonded to the metal substrate is recorded and this temperature is defined as the tack point. When the polyester has a definite melting point (which is determined as the endothermic peak in differential thermal analysis) as in case of a crystalline polymer, this tack point corresponds substantially to the temperature of the rising portion of the endothermic peak. When the polyester does not show a definite melting point as in case of an amorphous polymer, the tack point corresponds substantially to the softening point as measured according to the ring and ball method (JIS K-2531).

If the tack point of the polyester resin layer is lower than 130° C., when the resulting coated metal structure to shaping processing such as deep drawing, the operation efficiency is drastically lowered at the step of parting the resulting shaped article from a shaping mold. Further, the resin layer adheres to the mold and peeling is often caused.

In the case where the tack point is higher than 250° C., thermal degradation of the polymer often takes place when it is heat-bonded to the metal substrate, and a long time is required for fusion bonding or cooling of the polyester, resulting in reduction of the operation efficiency at the coating step. Moreover, a polyester having such a high tack point is ordinarily inferior with respect to the processability of the coating. The tack point of a thermoplastic polyester resin to be used in the present invention can be adjusted within the above-mentioned range by selecting appropriately the kind of the dibasic acid component or diol component in the recurring units of the polyester or choosing an appropriate combination of these two components. Namely, in the present invention, it is preferred that constituents of the thermoplastic polyester resin be selected so that the tack point of the resin layer is in the range of from 130° C. to 250° C.

In view of the peel resistance between the coating layer and metal substrate and the processability and corrosion resistance of the coated metal structure, it is very important that the coating layer of a thermoplastic polyester resin heat-bonded to a metal substrate has a degree of crystallinity in the range of 0% to 30%.

When a cylindrical metal vessel having a drawing ratio of 2.0 is formed from a metal plate by deep drawing or the like, if the flow state of the metal surface is observed by a scanning electron microscope or the like, it is seen that deformation of the metal is relatively small in the bottom portion of the vessel, but the flow of the metal surface gradually increases from the side face of the vessel toward the top thereof and the flow quantity is extremely large in the vicinity of the top end of the vessel. When a coated metal structure is subjected to processing in the same manner as described above, it is observed that the surface of the resin layer having a contact with the metal surface or the entire resin layer flows in follow-up of the flow of the metal surface. If the degree of crystallinity of the polyester resin layer is higher than 30%, during the above deformation large strains appear and partial peeling of the resin layer is caused or the resin layer is easily peeled off when a slight shock is given to the resulting shaped article while it is actually used. Accordingly, it is necessary that the degree of crystallinity of the polyester resin layer should be controlled within the range of from 0% to 30%. If the degree of crystallinity of the polyester resin layer is adjusted within this range, the interlaminar peel resistance, shaping processability and corrosion resistance of the resulting coated metal structure can be remarkably improved.

When the coated metal structure is used as a vessel of canned food or the like, it is often subjected to a heat treatment for outer surface printing or inner surface coating or at the step of filling the content or the sterilization step subsequent to the filling step. In this case, the degree of crystallinity of the polyester resin layer is ordinarily increased. In the coated metal structure of the present invention, it is preferred that the degree of crystallinity of the polyester resin layer be maintained at a level lower than 50%, especially lower than 40%, even after such heat treatment.

The degree of crystallinity referred to in the instant specification and claims is a value determined according to the following procedures.

(1) The X-ray diffraction intensity of the resin layer is measured within a range of $2\theta = 5$ to 40.
(2) A point of $2\theta = 10$ and a point of $2\theta = 35$ are connected by a straight line, and this line is designated as the base line.
(3) A substantially amorphous sample of a polyester resin having the same composition as that of the polyester resin layer is formed by a method comprising melting the polyester resin and throwing the melt into liquid nitrogen or other appropriate method, and the X-ray diffraction intensity of the sample is measured in the same manner as described in (1) above.
(4) A gentle curve is drawn by connecting skirt portions of the crystal diffraction peaks appearing on the diffraction curve obtained in (1) above so that it has a shape similar to the shape of the diffraction intensity curve obtained in (3) above.
(5) An area Ia surrounded by the base line obtained in (2) above and the curve obtained in (4) above and an area Ic surrounded by the curve obtained in (4) above and the diffraction intensity curve obtained in (1) above are measured.
(6) The degree of crystallinity (DC) is defined as follows:

$$DC = Ic/(Ia + Ic) \times 100$$

As means for adjusting the degree of crystallinity of the polyester resin layer in the coated metal structure to 0 to 30%, there may be adopted, for example, (a) a method in which the rate of crystallization of the polyester resin layer heat-bonded to the metal substrate is adjusted so that the resulting degree of crystallinity is controlled at a level not higher than 30%, (b) a method in which a copolyester is used for formation of the resin layer and the kinds of copolyester-constituting components or copolymerization ratios thereof are adjusted so that a highest attainable degree of crystallinity is 30% or lower, and (c) a method in which a plurality of polyester resins differing in crystallinity characteristics are blended so that a highest attainable degree of crystallinity is 30% or lower. The foregoing methods may be adopted in combination. At any rate, when a polyester resin shaped in advance into a film is bonded to a metal substrate, it is preferred that the film be in the undrawn state or the degree of orientation by drawing be low. When a film having a degree or orientation enhanced by drawing is used, the degree of crystallinity heat-bonded to a metal substrate is often higher than 30% and no good results are obtained. When the degree of crystallinity of the polyester resin layer is adjusted according to the above method (a), the desired adjustment is accomplished by controlling the cooling conditions at the cooling step subsequent to the heat-bonding step. Still further, it is possible to adjust the degree of crystallinity of the polyester resin layer at a desirable level by incorporating a suitable crystallizing agent or plasticizer in the starting polyester resin.

The material of the metal substrate that is used in the present invention is not particularly critical in the present invention. For example, there can be used an untreated steel plate (black plate), a phosphoric acid-treated steel plate, a chromic acid-treated steel plate, a tin free steel plate, a chromium-coated steel plate, a zinc-coated steel plate, an aluminum-coated steel plate an iron plate, an aluminum plate, a chromium-coated aluminum plate, a copper-plated steel plate, a tin-coated steel plate and the like. Various steel and aluminum materials are especially preferred as the metal substrate. These metal materials, in general, are used in the form of a plate or foil after they have been sufficiently degreased. These metal substrates may be subjected to a surface treatment such as acid washing, oxidizing and reducing treatments according to need.

The method for formation of the coated metal structure of the present invention is not particularly critical. However, in general, it is preferred to adopt a film lamination method comprising shaping a polyester resin into a film according to known procedures and heat-bonding the film to a metal substrate and an extrusion lamination method comprising extruding a melt of a polyester resin on a metal substrate to thereby form a coating directly on the metal substrate. If desired, there may be adopted a method in which a primer of the thermo-setting type or an anchoring agent of the isocyanate type is coated on a polyester resin film or metal substrate and the polyester resin film is heat-bonded to the metal substrate. The heat bonding temperature ($T_2$) is determined depending on the tack point ($T_1$) of the polyester resin, and in general, the heat bonding is carried out at a temperature in the range of from $T_1$ to ($T_1$ + 130)°C., preferably from ($T_1$ + 20)°C. to ($T_1$ + 100)°C.

In preparing the coated metal structure of the present invention, it is preferred that a coated metal structure to which a thermoplastic polyester resin layer is heat-bonded be quenched so that the degree of crystallinity of the polyester resin layer is in the range of 0 to 30%. Known means may be adopted for this quenching operation. For example, there can be adopted a method in which a cooling medium such as cooling water is sprayed on the coated metal structure, a method in which the coated metal structure is dipped in a cooling medium such as cooling water, and a method in which the coated metal is passed through quenching rollers. These methods may be adopted in combination. In order to control the degree of crystallinity of the polyester resin layer below 30%, it is preferred to quench the resin layer of the coated metal structure from the hot bonding temperature [$T_2 = T_1$ to $T_1$ + 130° C., especially $T_1$ + 20 to $T_1$ + 100° C.] to a level lower than 70° C., especially a level lower than 50° C., within 60 seconds.

The thickness of the coating layer is varied depending on the desired degree of coating and the intended use of the coated metal structure, but in general, it is preferred that the thickness of the polyester resin coating in the state applied on the surface of the metal substrate be 1 to 100μ, especially 5 to 60μ.

In the so prepared coated metal structure of the present invention, the polyester resin coating is tightly bonded to the metal substrate and the surface condition is very good. The coated metal structure may be used directly in the as-prepared plate-like or foil-like form. Since the adaptability of the coated metal structure of the present invention to shaping processing is very excellent as pointed out hereinbefore, it can be conveniently subjected to various shaping processings, for example, deep drawing, ironing, folding, bending, flanging, beading, curling, climping and stamping, and it can be formed into various shaped articles such as vessels, can bodies, retortable pouches, vessel lids, casings of electric instruments or office instruments, toys, roofing materials, wall materials and armoring and inner lining materials of vehicles or ships. These shaped articles can be used effectively in various fields.

The coated metal structure of the present invention is characterized in that since the thermoplastic polyester resin constituting the resin layer is heat-bonded to the metal substrate and the degree of crystallinity of this resin layer is controlled within the specific range, severe processing conditions can be applied to the coated metal structure and even after they have been subjected to shaping processing conducted under severe conditions, excellent adhesion (peel resistance) of the resin coating and excellent corrosion resistance of the metal substrate can be retained.

By virtue of the above characteristic properties, the coated metal structure of the present invention can be effectively used as a material for various vessels and containers. In this case, the coated metal structure is formed into a vessel or container according to known means so that the thermoplastic polyester resin coating layer is located at least on the inner surface of the vessel or container.

For example, the coated metal structure of the present invention can be conveniently used as a metal blank for production of can bodies. In this case, the coated metal structure of the present invention is cut into a prescribed can body size, the cut blank is fed to a can making machine and shaped into a roll, and both the side edges of the blank are heat-bonded in the lapped state. Since the thermoplastic polyester resin used in the present invention has excellent heat bondability, formation of side seams by heat bonding can be accomplished very easily. This heat bonding can readily be performed by heating in advance facing side portions of the blank at a temperature causing softening of the thermoplastic polyester resin and pressing the heated side portions of the blank under cooling.

The so prepared cup is subjected to flanging or beading according to known means and it is then double-seamed with a can lid to form a final can body.

Instead of the above-mentioned lap bonding method, there may be adopted a method in which facing side portions of the blank are bonded through a lock seam or a combination of a lock seam with a lap seam. In each case, the coated polyester resin layer per se can be used as a hot melt adhesive, or other hot melt adhesive or a synthetic rubber type sealing material or hot curing type adhesive may be applied from the outside and used for bonding.

The coated metal structure of the present invention can be shaped into a side seamless container according to known means. In this case, the coated metal structure is subjected to deep drawing of at least one stage between a driving die and a punch to form a cup comprising a side wall portion having no seam and a bottom integrated seamlessly with the side wall portion, and if desired, the side wall portion of the resulting cup is subjected to ironing. Thus, a side seamless container can be prepared from the coated metal structure of the present invention.

Since the coated metal structure of the present invention is excellent in the adaptability to shaping processing, it can be subjected to such deep drawing treatment that the drawing ratio ($R_D$) defined by the following formula:

$$R_D = D/d$$

wherein D stands for a minimum diameter of the coated metal structure to be processed and d stands for a minimum diameter of a punch, is in the range of from 1.1 to 3.0, especially from 1.2 to 2.8, and it can also be subjected to such ironing treatment that the ironing ratio ($R_1$) defined by the following formula:

$$R_1 = t_0 - t_1/t_0 \times 100$$

wherein $t_0$ stands for the thickness of the metal blank before ironing and $t_1$ stands for the thickness of the metal plate after ironing, is in the range of 10 to 50% at one-stage ironing and is in the range of 10 to 80% as a whole.

The so prepared seamless container comprises a side wall portion having no seam and a bottom portion seamlessly integrated with the side wall portion. The thickness of the bottom is substantially the same as the thickness of the coated metal structure used as the blank. When only drawing is performed, the thickness of the side wall portion is substantially the same as the thickness of the coated metal structure used, and when both drawing and ironing are carried out, the thickness of the side wall portion is smaller than that of the coated metal structure used. This side seamless vessel may further be subjected to doming, necking-in and beading according to need and then to flanging, whereby a can body which can be double-seamed with a can lid or closure is formed.

Further, since the coated metal structure of the present invention is excellent in the adaptability to shaping processing, it can easily be shaped into various vessel lids and closures, for example, crown caps, screw caps, twist-off caps, peelable caps and can lids. In each case, advantages as mentioned above with respect to formation of containers are similarly attained. Especially, when the coated metal structure of the present invention is used for formation of can lids, processing for attaching an opening mechanism such as an easy open end can easily be performed while retaining the excellent corrosion resistance. This is another advantage attained by the present invention.

As will be apparent from the foregoing illustration, the coated metal structure of the present invention can easily be formed and processed into various containers and vessels differing in the shape, and even after such forming processing, the adhesion (peel resistance) of the coating and the corrosion resistance of the metal substrate can be maintained at high levels. Moreover, when foods or the like are filled in such containers, the coating-constituting components are not extracted by the contents and the effect of retaining flavors of the contents is prominently excellent. Furthermore, these characteristics are not lost at all by severe post treatments such as high-temperature sterilization. Because of the excellent heat bondability of the coating of the coated metal structure of the present invention, a finishing treatment such as fusion bonding of a printed film can easily be performed.

The present invention will now be described in detail by reference to the following Examples that by no means limit the scope of the invention.

EXAMPLE 1

A 30-$\mu$ thick film composed of a poly(tetramethylene terephthalate) having a relative viscosity of 1.55 as measured at 25° C. in o-chlorophenol at a concentration of 0.5 g/100 ml (the same will apply hereinafter) and a tack point of 224° C., which had a degree of crystallinity of 12%, was heat-bonded under conditions indicated in Table 1 to a 0.17-mm thick cold-rolled steel plate, the surface of which had been sufficiently degreased by using trichloroethylene. A part of the resin layer of the resulting coated steel plate was sampled and the relative viscosity and degree of crystallinity were measured. The coated steel plate was subjected to the drawing test at a drawing ratio of 1.9 by using a drawing mold for forming a cup having an inner diameter of 50 mm so that the resin layer was located inside. The resulting cup was subjected to the salt spray test for 5 days according to the method of JIS Z-2371. Measurement results and test results are shown in Table 1.

Coating methods A to E mentioned in Table 1 are as follows:

Coating Method A:

The film was preliminarily bonded under compression of 1.5 Kg/cm$^2$ by means of a roll to the steel plate pre-heated at 240° C., and then, the steel plate was heated at 260° C. for 30 seconds to completely bond the film to the steel plate. Then, the coated steel plate was cooled for 6 seconds by liquid $N_2$.

Coating Method B:

The preliminary bonding and finish bonding were performed in the same manner as in the coating method A, and the coated steel plate was cooled for 60 seconds in water maintained at 0° C.

Coating Method C:

The preliminary bonding and finish bonding were performed in the same manner as in the coating method A, and the coated steel plate was cooled for 60 seconds in water maintained at 50° C.

Coating Method D:

The preliminary bonding and finish bonding were performed in the same manner as in the coating method A, and the coated steel plate was naturally cooled in air.

Coating Method E:

The preliminary bonding and finish bonding were performed in the same manner as in the coating method A, and the coated steel plate was forcibly cooled to 110° C. and then naturally cooled in air.

Table 1

| Run No. | Coating Method | Properties of Coating Resin Layer: Relative Viscosity | Properties of Coating Resin Layer: Degree (%) of Crystallinity | Adaptability of Coated Steel Plate to Drawing Processing | Properties of Shaped Articles: Salt Spray Test (for 5 days) According to JIS Z-2371 | Actual Application Test*: Rusting | Actual Application Test*: Peeling of Coating |
|---|---|---|---|---|---|---|---|
| 1 | A | 1.48 | 0 | good | not rusting | not observed | not observed |
| 2 | B | 1.46 | 17 | good | not rusting | not observed | not observed |
| 3 | C | 1.46 | 27 | almost good | not rusting | not observed | not observed |
| 4 | D | 1.45 | 37 | bad (peeling occurred on side wall of cup) | rusting and peeling advanced | partially rusting | partially peeling |
| 5 | E | 1.45 | 33 | slightly bad (slight peeling occurred on side wall of cup) | not rusting | spot rusting in double-seamed portion | peeling in double-seamed portion |

Note

*The cup having a diameter of 50 mm was trimmed and subjected to flanging. Then, tuna flakes were filled in the resulting can body and a lid was attached to the filled can body by double seaming. The packed can was heated and sterilized at 118° C. for 90 minutes and stored for 1 hour.

EXAMPLE 2

A polyester resin having a relative viscosity of 1.55, which comprised as the dicarboxylic acid component terephthalic acid (abbreviated to "TPA") and isophthalic acid (abbreviated to "IPA") at a mixing molar ratio indicated in Table 2 and 1,4-butane diol as the diol component, was molten and formed into a film having a thickness of 30 to 33μ. The film was preliminarily bonded under compression of 2.0 Kg/cm$^2$ by means of a roll to a surface-cleaned cold-rolled steel plate preheated at a temperature higher by 15° C. than the tack point of the polyester resin, and then, the metal plate was heated at a temperature higher by 30° C. than the tack point of the polyester for 30 seconds to complete bonding. The coated steel plate was immediately passed through water maintained at 20° C. for 60 seconds to cool the coated steel plate. A part of the resin layer was sampled and the relative viscosity and degree of crystallinity were measured to obtain results shown in Table 2. Then, the coated steel plate was subjected to the drawing test at a drawing ratio of 1.8 by using a drawing mold for forming a cup having an inner diameter of 50 mm so that the resin layer was located outside. The resulting shaped article was subjected to the salt spray test to obtain results shown in Table 2.

Table 2

| Run No. | TPA/IPA Molar Ratio on Resin Layer | Properties of Resin Layer: Tack Point (° C.) | Properties of Resin Layer: Degree of Crystallinity (%) | Adaptability to Drawing Processing | Salt Spray Test (5 days) of Shaped Article according to JIS Z-2371 |
|---|---|---|---|---|---|
| 1 | 100/0 | 224 | 27 | almost good | not rusting |
| 2 | 80/20 | 193 | 5 | good | not rusting |
| 3 | 70/30 | 175 | 0 | good | not rusting |
| 4 | 60/40 | 163 | 0 | good | not rusting |
| 5 | 50/50 | 132 | 0 | almost good, mold releasing property of shaped article slightly bad | not rusting |
| 6 | 40/60 | 115 | 0 | bad, resin layer adhering to mold | rusting, peeling advanced |

Table 2-continued

| Run No. | TPA/IPA Molar Ratio on Resin Layer | Properties of Resin Layer: Tack Point (° C.) | Properties of Resin Layer: Degree of Crystallinity (%) | Adaptability to Drawing Processing | Salt Spray Test (5 days) of Shaped Article according to JIS Z-2371 |
|---|---|---|---|---|---|
| | | | | during processing | |

EXAMPLE 3

A 35-μ thick film of a polyester comprising terephthalic acid as the dicarboxylic acid component and as the diol component 70 mole % of 1,4-butane diol and 30 mole % of ethylene glycol, which had a degree of crystallinity of 5% and a tack point of 220° C., was preliminarily bonded under compression of 2.0 Kg/cm$^2$ by means of a roll to a 0.35 mm thick chromic acid-treated steel plate pre-heated at 260° C., and the steel plate was heated at 280° C. for 30 seconds to complete bonding. Then, the coated steel plate was passed through water maintained at room temperature for 60 seconds to effect cooling. The resin layer of the resulting coated steel plate had a relative viscosity of 1.30 and a degree of crystallinity of 5%. The coated steel plate was subjected to drawing processing at a drawing ratio of 1.5 to obtain a cup, having a diameter of 70 mm. The shaped article was drawn again so that the diameter became 50 mm and then ironed to obtain a cup having a diameter of 50 mm. At this step, the ironing ratio was 20%. The resulting shaped article had a good appearance, and when it was subjected to the salt spray test for 5 days according to the method of JIS Z-2371, rusting was not observed at all.

This cup was trimmed and subjected to flanging, and 100% orange juice was hot-packed in the resulting can and a lid was attached according to a customary double seaming method. The packed orange juice was stored at 37° C. for 6 months, and when the can was opened and the content was examined, it was found that the cup had a very excellent preservative effect.

EXAMPLE 4

A pelletized polyester resin having a relative viscosity of 1.49 and a tack point of 140° C., which comprised as the dicarboxylic acid component 80 mole % of terephthalic acid and 20 mole % of sebacic acid and as the diol component 80 mole % of 1,4-butane diol and 20 mole % of 1,6-hexane diol, was fed to an extruder having a screw diameter of 40 mm and being provided with extrusion lamination equipments, in which the extrusion temperature was maintained at 200° C. Simultaneously, a sufficiently degreased 0.34-mm thick aluminum thin plate was continuously fed just below a die. Under application of a pressure of 2.0 Kg/cm$^2$ an extruded resin layer was press-bonded to the aluminum thin plate by using a pressing roll, and the coated aluminum plate was passed through water maintained at 25° C. to effect cooling. The degree of crystallinity of the resin layer of the resulting coated aluminum plate was substantially 0%. This coated aluminum plate was shaped into a vessel having an inner diameter of 60 mm and a height of 80 mm by subjecting the coated aluminum plate to drawing processing so that the resin layer was located inside. The resulting shaped vessel had good properties. When the shaped article was subjected to the salt spray test in the same manner as described in the preceding Examples, no corrosion was caused on the coated surface. A liver paste was filled in the so prepared can body and a lid composed of the above coated aluminum plate was attached to the can body by double seaming. The packed can was sterilized at 120° C. and stored for 6 months. When the can was opened and the content was examined, no change was observed, and it was found that good performance was attained.

EXAMPLE 5

A poly(tetramethylene terephthalate/isophthalate) having a tack point of 175° C., which comprised as the dicarboxylic acid component terephthalic acid and isophthalic acid at a molar ratio of 70/30 was synthesized. The relative viscosity of the polymer was 1.48.

The so prepared polyester (80 parts by weight) and 20 parts by weight of an ethylene-ethyl acrylate copolymer (ethylene/ethyl acrylate weight ratio = 95/5) were molten and kneaded by using an extruder. The resulting polymer chips were fed to an extruder provided with a T-die, and molten and coated on a chromic acid-treated steel plate having a thickness of 0.22 mm, which was heated at 280° C. Then, the coated steel plate was cooled with water. The extrusion conditions were adjusted so that the thickness of the resin layer was 50 to 55μ. The degree of crystallinity of the resin layer was 5%.

The coated steel plate was punched into a disc and then subjected to drawing processing. By conducting deep drawing twice, a cup having an inner diameter of 107 mm was prepared at a drawing ratio of 2.13. The resulting cup was washed with hot water, and boiled and flavored tuna was packed in the cup. A lid formed by punching the above resin coated steel plate into a disc-like form was attached to the packed cup by double seaming. The sterilization was carried out at 120° C. for 90 minutes and the packed can was stored at 50° C. for 2 months. When the can was opened and the content was examined, it was found that no change was caused in the content and no rusting was observed on the vessel.

EXAMPLE 6

A polymer blend comprising 30% by weight of a polyester having a relative viscosity of 1.37 and a tack point of 215° C., which comprised as the dicarboxylic acid component 80 mole % of terephthalic acid and 20 mole % of isophthalic acid and as the diol component ethylene glycol and 70% by weight of a polyester having a relative viscosity of 1.53 and a tack point of 170° C., which comprised as the dicarboxylic acid component 65 mole % of terephthalic acid and 35 mole % of isophthalic acid and as the diol component butylene glycol was formed into an unstretched film having a thickness of 50μ by using an extruder in which the extrusion temperature was set at 250° C. The so prepared film was preliminarily bonded under compression of 2.0 Kg/cm$^2$ by means of a roll to a surface-cleaned chromic acid-treated steel plate, and the steel plate was then heated at 270° C. for 40 seconds to complete bonding. The coated steel plate was passed through water maintained at 25° C. for 60 seconds to effect cooling. The degree of crystallinity of the resin layer of the resulting coated steel plate was substantially 0%. The coated steel plate was subjected to draw processing at a drawing ratio of 2.0 to form a cup having an inner diameter of 100 mm. Tuna flakes were packed in the resulting cup and sterilization was conducted at 120° C. for 120 minutes. By this treatment, the degree of crystallinity of the resin layer was increased to 35%. After the sterilization, a lid composed of the above coated steel plate was attached to the packed can be double seaming. The packed can was stored for 1 year. When the can was opened and the content was examined, it was found that the content was kept in good conditions and no rusting was observed on the vessel.

What we claim is:

1. A metal can formed from a coated metal structure wherein said coated metal structure consists essentially of a metal substrate and only a single overcoat layer composed primarily of a thermoplastic polyester resin which is heat-bonded directly to the surface of said metal substrate, said polyester resin being composed of recurring units represented by the following formula:

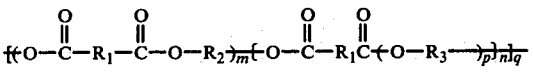

wherein $R_1$ stands for a divalent hydrocarbon group, at least 45 mole % of which is a p-phenylene group, each of $R_2$ and $R_3$ stands for a divalent aliphatic hydrocarbon group, at least 45 mole % of which is a tetramethylene group, p and q each stands for a number equal to at least 1, and m and n each selectively stands for 0 or a number equal to at least 1 with the proviso that when one of m and n is 0 the other of m and n must be a number equal to at least 1, and having a relative viscosity of 1.2 to 1.8 as measured at 25° C. in o-chlorophenol at a concentration of 0.5 g/100 ml, and the tack point of said polyester resin being not lower than 130° C. and the degree of crystallinity of said polyester resin being up to 30%.

2. A metal can as set forth in claim 1 wherein the thermoplastic polyester is at least one member selected from the group consisting of poly(tetramethylene terephthalate), poly(tetramethylene/ethylene terephthalate), poly(tetramethylene terephthalate/isophthalate), poly(ethylene terephthalate/isophthalate), poly(ethylene/p-hexahydroxylylene terephthalate) and poly(tetramethylene/polyoxytetramethylene terephthalate).

3. A metal can as set forth in claim 1 wherein said layer is a blend of at least 70% by weight of said thermoplastic polyester resin and up to 30% by weight of other thermoplastic resin.

4. A metal closure formed from a coated metal structure wherein said coated metal structure consists essentially of a metal substrate and only a single overcoat layer composed primarily of a thermoplastic polyester resin which is heat-bonded directly to the surface of said metal substrate, said polyester resin being composed of recurring units represented by the following formula:

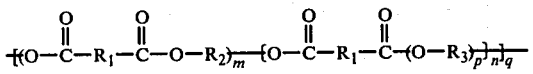

wherein $R_1$ stands for a divalent hydrocarbon group, at least 45 mole % of which is a p-phenylene group, each of $R_2$ and $R_3$ stands for a divalent aliphatic hydrocarbon group, at least 45 mole % of which is a tetramethylene group, p and q each stands for a number of at least 1, and m and n each selectively stands for 0 or a number equal to at least 1 with the proviso that when one of m and n is 0 the other of m and n must be a number equal to at least 1, and having a relative viscosity of 1.2 to 1.8 as measured at 25° C. in o-chlorophenol at a concentration of 0.5 g/100 ml, and the tack point of said polyester resin being not lower than 130° C. and the degree of crystallinity of said polyester resin being up to 30%.

5. A metal closure as set forth in claim 4 wherein the thermoplastic polyester is at least one member selected from the group consisting of poly(tetramethylene terephthalate), poly(tetramethylene/ethylene terephthalate), poly(tetramethylene terephthalate/isophthalate), poly(ethylene terephthalate/isophthalate), poly(ethylene/p-hexahydroxylylene terephthalate) and poly(tetramethylene/polyoxytetramethylene terephthalate).

6. A metal closure as set forth in claim 4 wherein said layer is a blend of at least 70% by weight of said thermoplastic polyester resin and up to 30% by weight of other thermoplastic resin.

7. A side seamless container formed from a coated metal blank by drawing or drawing-ironing, which comprises a side wall portion without a seam on the side face thereof and a bottom portion seamlessly integrally connected with said side wall portion, wherein said coated metal blank consists essentially of a metal substrate and only a single overcoat layer composed mainly of a thermoplastic polyester resin, which is heat-bonded directly to at least one surface of said metal substrate, said polyester resin being composed of recurring units represented by the following formula:

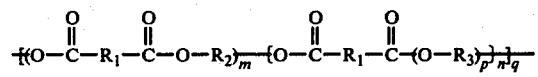

wherein $R_1$ stands for a divalent hydrocarbon group, at least 45 mole % of which is a p-phenylene group, each of $R_2$ and $R_3$ stands for a divalent aliphatic hydrocarbon group, at least 45 mole % of which is a tetraethylene group, p and q each stands for a number equal to at least 1, and m and n each selectively stands for 0 or a number equal to at least 1 with the proviso that when one of m and n is 0 the other of m and n must be a number equal to at least 1, and having a relative viscosity of 1.2 to 1.8 as measured at 25° C. in o-chlorophenol at a concentration of 0.5 g/100 ml, and the tack point of said polyester resin being not lower than 130° C. and the degree of crystallinity of said polyester resin being up to 30%.

8. A side seamless container as set forth in claim 7 wherein the thermoplastic polyester is at least one member selected from the group consisting of poly(tetramethylene terephthalate), poly(tetramethylene/ethylene terephthalate), poly(tetramethylene terephthalate/isophthalate), poly(ethylene terephthalate/isophthalate), poly(ethylene/p-hexahydroxylene terephthalate) and poly(tetramethylene/polyoxytetramethylene terephthalate).

9. A container as set forth in claim 7 wherein the thickness of the coating layer is in the range of from 1μ to 100μ.

10. A container as set forth in claim 7 wherein the coating layer is formed at least on that surface of the metal substrate which constitutes the inner surface of the container.

11. A side seamless container as set forth in claim 7 wherein said layer is a blend of at least 70% by weight of said thermoplastic polyester resin and up to 30% by weight of other thermoplastic resin.

* * * * *